US007951048B1

(12) United States Patent
Hsiung

(10) Patent No.: US 7,951,048 B1
(45) Date of Patent: May 31, 2011

(54) ABDOMINAL SWIVELING EXERCISE MACHINE COMBINED WITH AN ELLIPTICAL TRAINER EXERCISE MACHINE, OR SKATE SIMULATION TRAINER, OR EXERCISE BICYCLE OR RECUMBENT BICYCLE

(75) Inventor: Bob Hsiung, Walnut, CA (US)

(73) Assignee: Hupa International, Inc., Walnut, CA (US)

( * ) Notice: Subject to any disclaimer, the term of this patent is extended or adjusted under 35 U.S.C. 154(b) by 0 days.

(21) Appl. No.: 12/661,710

(22) Filed: Mar. 22, 2010

(51) Int. Cl.
*A63B 22/00* (2006.01)
*A63B 22/12* (2006.01)

(52) U.S. Cl. ..... 482/52; 482/62

(58) Field of Classification Search ..... 482/51–53, 482/57–65, 145–147
See application file for complete search history.

(56) References Cited

U.S. PATENT DOCUMENTS 3,134,378 A * 5/1964 Harwood ..... 601/36
3,809,393 A * 5/1974 Jones ..... 482/132
4,479,646 A * 10/1984 Beistegui Chirapozu ..... 482/62
4,586,706 A * 5/1986 Chen ..... 482/62
5,749,813 A * 5/1998 Domzalski ..... 482/97
6,102,833 A * 8/2000 Chen ..... 482/53
6,244,995 B1 * 6/2001 Prsala ..... 482/96
6,248,047 B1 * 6/2001 Abdo ..... 482/130
6,719,665 B1 * 4/2004 Lai ..... 482/52
6,902,515 B2 * 6/2005 Howell et al. ..... 482/62
6,910,991 B2 * 6/2005 Matsumoto ..... 482/8
6,918,860 B1 * 7/2005 Nusbaum ..... 482/57
6,942,605 B1 * 9/2005 Sukhovitsky ..... 482/132
7,585,263 B2 * 9/2009 Brown et al. ..... 482/142
7,611,445 B2 * 11/2009 Brown et al. ..... 482/51
7,727,121 B1 * 6/2010 Wang ..... 482/52
7,775,953 B2 * 8/2010 Wang ..... 482/147
7,794,361 B2 * 9/2010 Wang ..... 482/51
2003/0171190 A1 * 9/2003 Rice ..... 482/57
2004/0204294 A2 * 10/2004 Wilkinson et al. ..... 482/54
2005/0101463 A1 * 5/2005 Chen ..... 482/142
2007/0287618 A1 * 12/2007 Verheem ..... 482/140
2009/0011905 A1 * 1/2009 McKee ..... 482/52
2009/0075784 A1 * 3/2009 Hoggan ..... 482/54
2010/0204018 A1 * 8/2010 Hoggan ..... 482/54

* cited by examiner

*Primary Examiner* — Steve R Crow
(74) *Attorney, Agent, or Firm* — Thomas I. Rozsa

(57) ABSTRACT

A combination exercise device including a combination elliptical trainer and abdominal swivelling exercise machine, a combination skating simulation exercise machine and abdominal swivelling exercise machine, an exercise bicycle combined with an abdominal swivelling exercise machine and a recumbent exercise bicycle combined with an abdominal swivelling exercise machine.

2 Claims, 11 Drawing Sheets

ABDOMINAL SWIVELING EXERCISE MACHINE COMBINED WITH AN ELLIPTICAL TRAINER EXERCISE MACHINE, OR SKATE SIMULATION TRAINER, OR EXERCISE BICYCLE OR RECUMBENT BICYCLE

BACKGROUND OF THE INVENTION

1. Field of the Invention

The present invention relates to the field of exercise machines and in particular, to exercise machines which enable a user to perform riding exercises such as elliptical training, skating simulation or bicycle training, combined with an exercise machine which enables a user to perform abdominal swivelling exercises to tighten stomach muscles and reduce the user's waistline.

2. Description of the Prior Art

In general, there are numerous types of exercise machines on the market. One type of machine is an elliptical trainer which enables a user to perform elliptical training riding exercises. Another type of exercise machine is a skating simulation machine. Another type of exercise machine is an exercise bicycle. Another type of exercise machine is a recumbent bicycle. However, there is no exercise machine which combines an elliptical trainer or a skating simulator, or an exercise bicycle or a recumbent bicycle with a swivelling exercise machine which enables a user to exercise the user's abdominal muscles to strengthen the user's abdominal muscles and reduce the user's waist. There is a significant need for such a machine to enable a user to save exercise floor space and perform the two different exercises on the same machine to thereby make an exercise session more efficient.

SUMMARY OF THE INVENTION

The present invention is a combination exercise machine selected from the group consisting of an elliptical trainer exercise machine, a skating simulation exercise machine, an exercise bicycle and a recumbent bicycle, each selectively combined with an abdominal swivelling exercise machine which enables a user to perform both exercises in one machine. The machine enables a user to save exercise floor space and perform the two different exercises on the same machine to thereby make an exercise session more efficient. The machine combines the features of an elliptical trainer exercise machine, a skating simulation exercise machine, an exercise, bicycle and a recumbent bicycle, each selectively combined with an abdominal swivelling exercise machine which enables a user to exercise and tighten stomach muscles.

One portion of the present invention is an elliptical trainer exercise machine which enables a user to perform elliptical training exercises. The machine can be locked so that this is the only exercise which can be performed. The machine can also be unlocked to also enable a user to perform swivelling exercises on the machine.

In an alternative embodiment, one portion of the present invention is a skating simulation exercise machine which enables a user to perform skating exercises. The machine can be locked so that this is the only exercise which can be performed. The machine can also be unlocked to also enable a user to perform swivelling exercises on the machine.

In another alternative embodiment, one portion of the present invention is an exercise bicycle machine which enables a user to perform stationary bicycle riding exercises. The machine can be locked so that this is the only exercise which can be performed. The machine can also be unlocked to also enable a user to perform swivelling exercises on the machine.

In yet another alternative embodiment, one portion of the present invention is a recumbent bicycle machine which enables a user to perform stationary recumbent bicycle riding exercises. The machine can be locked so that this is the only exercise which can be performed. The machine can also be unlocked to also enable a user to perform swivelling exercises on the machine.

It is therefore an object of the present invention to provide a combination elliptical trainer and abdominal swivelling exercise machine which enables a user to perform both exercises in one machine. The machine enables a user to save exercise floor space and perform the two different exercises on the same machine to thereby make an exercise session more efficient. The machine combines the features of an elliptical trainer which enables a user to perform elliptical training riding exercises and also has the features of an abdominal swivelling exercise machine which enables a user to exercise and tighten stomach muscles.

It is another object of the present invention to provide a combination skating simulation trainer and abdominal swivelling exercise machine which enables a user to perform both exercises in one machine. The machine enables a user to save exercise floor space and perform the two different exercises on the same machine to thereby make an exercise session more efficient. The machine combines the features of a skating simulation 1 trainer which enables a user to perform skating exercises and also has the features of an abdominal swivelling exercise machine which enables a user to exercise and tighten stomach muscles.

It is also an object of the present invention to provide a combination exercise bicycle and abdominal swivelling exercise machine which enables a user to perform both exercises in one machine. The machine enables a user to save exercise floor space and perform the two different exercises on the same machine to thereby make an exercise session more efficient. The machine combines the features of an exercise bicycle which enables a user to perform stationary bicycle riding exercises and also has the features of an abdominal swivelling exercise machine which enables a user to exercise and tighten stomach muscles.

It is also a further object of the present invention to provide a combination recumbent bicycle and abdominal swivelling exercise machine which enables a user to perform both exercises in one machine. The machine enables a user to save exercise floor space and perform the two different exercises on the same machine to thereby make an exercise session more efficient. The machine combines the features of a recumbent bicycle which enables a user to perform stationary recumbent bicycle riding exercises and also has the features of an abdominal swivelling exercise machine which enables a user to exercise and tighten stomach muscles.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
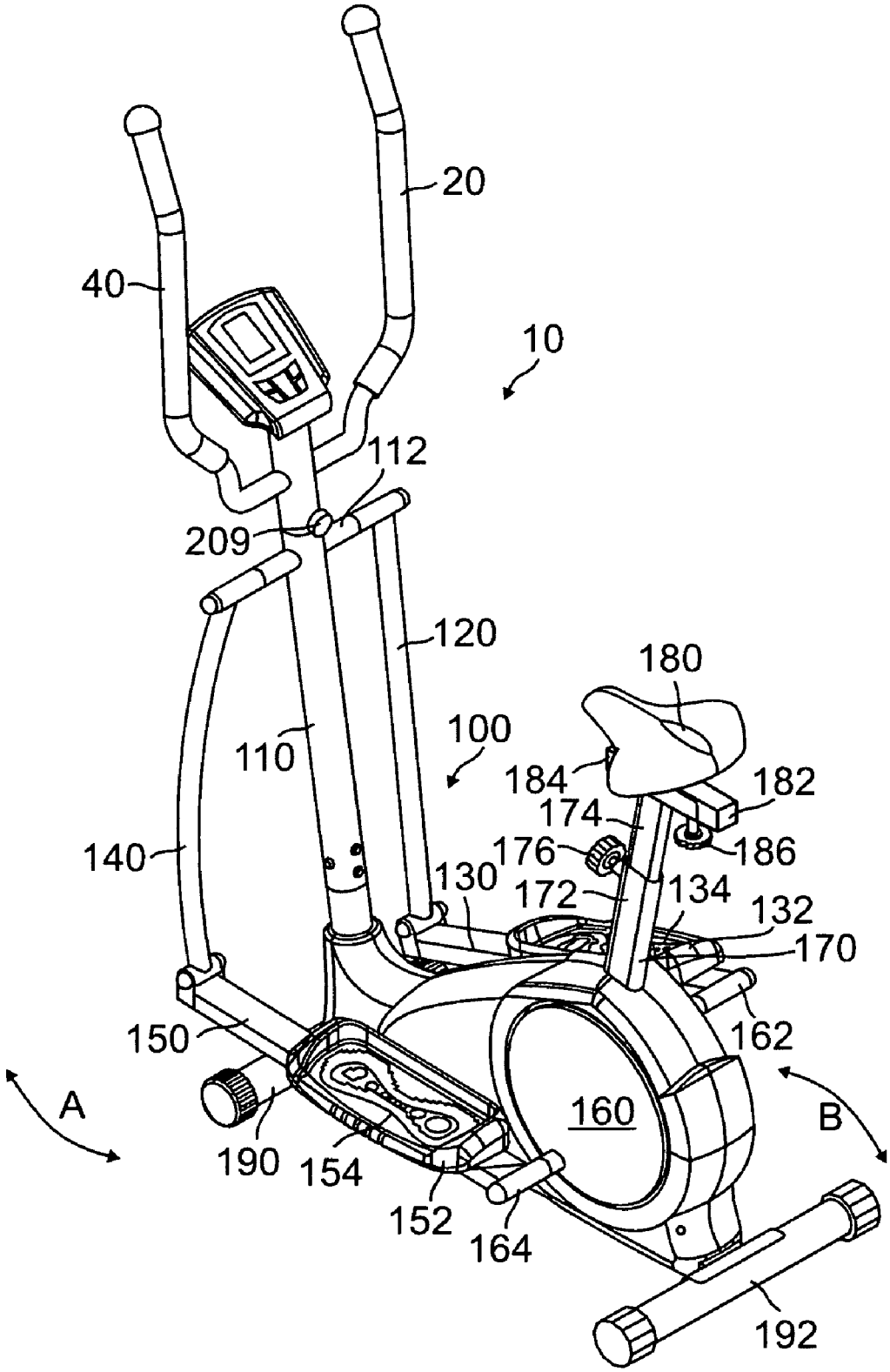
FIG. 1 is a perspective view of the present invention combination elliptical trainer exercise machine and abdominal swivelling exercise machine, with the swivelling apparatus locked by a pin so only the elliptical trainer exercise can be performed.

Referring to FIG. 1, there is illustrated a perspective view of a first embodiment of the present invention combination elliptical trainer exercise machine and abdominal swivelling exercise machine 10, with the swivelling apparatus locked by a pin so only the elliptical trainer exercise can be performed. The elliptical trainer portion 100 is fairly conventional and will only be briefly described. The elliptical trainer portion 100 has a central vertical post 110 surrounding a horizontal bar 112. A right vertical post 120 is rotatably connected to a right side of the horizontal bar 112. At its opposite end, right vertical post 120 is connected to a right horizontal support beam 130 which supports a right foot rest member 132 with interior right foot support plate 134. A left vertical post 140 is rotatably connected to a left side of the horizontal bar 112. At its opposite end, left vertical post 140 is connected to a left horizontal support beam 150 which supports a left foot rest member 152 with interior left foot support plate 154.

The elliptical trainer portion 100 also comprises a rotating drum 160 connected to a seat post 170 having a lower section 172 and a telescoping upper section 174 with an adjustment knob 176 so that the height of the seat 180 can be adjusted. The seat 180 is also connected to a horizontal telescoping bar having sections 182 and 184 with an adjustment knob 186 so that position of the seat 180 relative to the post 110 can be adjusted. The rotating drum 160 has a right connection bar 162 connected to right horizontal support beam 130 and a left connection bar 164 connected to left horizontal support beam 150.

In operation, a rider sits on seat 180 and places his right foot into right foot support plate 134 and places his left foot into left foot support plate 154. The rider can also hold onto right handle 20 and left handle 40 if the rider wishes. The handles 20 and 40 are connected by horizontal bars 22 and 42. The pedaling action is in the direction of arrow "A" and an elliptical rotational motion of the legs and a back and forth rotational arc motion of the seat 180 in the direction of arrow "B" is caused by a pedaling action of the rider.

Figure 9:
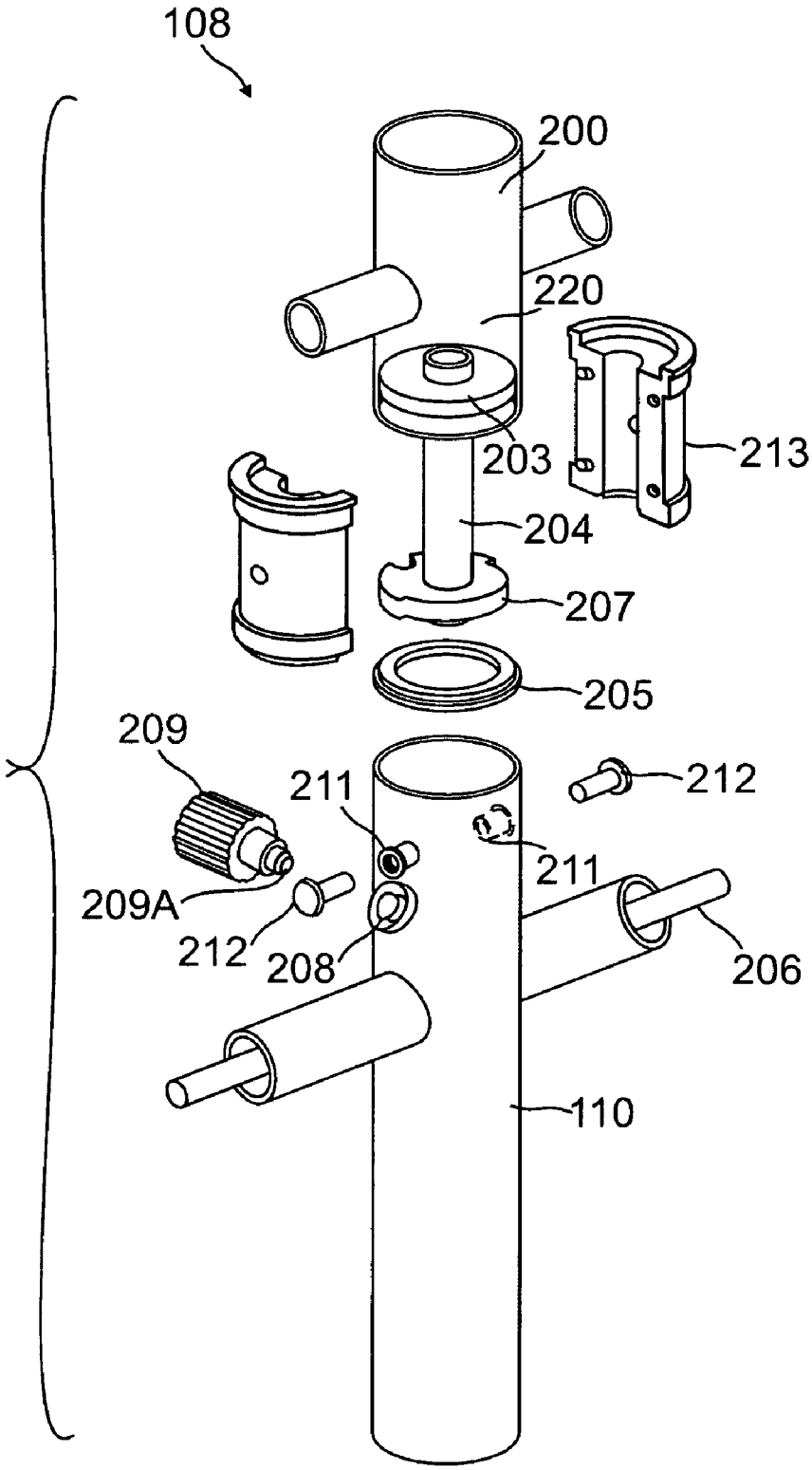
FIG. 9 is an exploded view of an embodiment of the internal swivelling exercise locking mechanism using a spring loaded locking screw.
Figure 10:
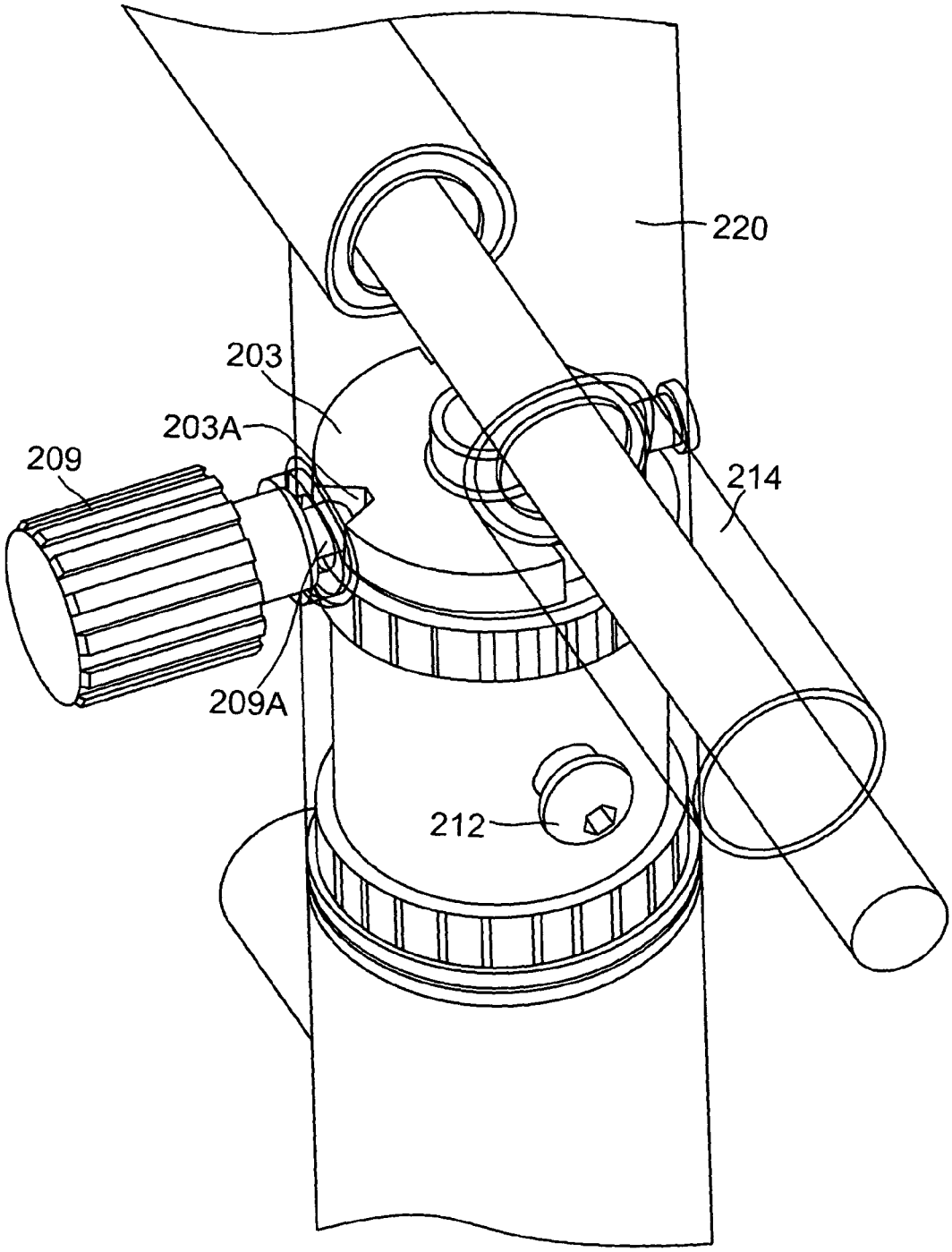
FIG. 10 is a see-through perspective view of the embodiment of the internal swivelling exercise locking mechanism illustrated in FIG. 9.
Figure 11:
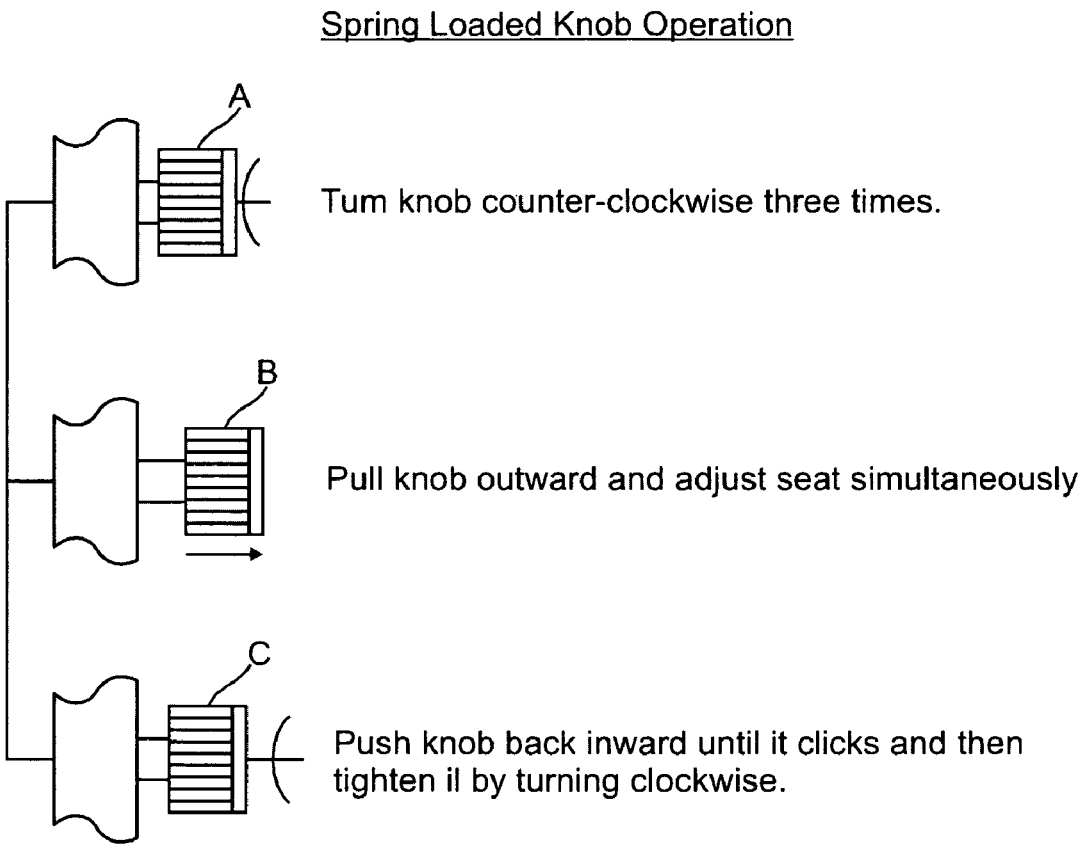
FIGS. 11A-C are perspective views of the spring loaded locking knob in three different configurations.

The abdominal swivelling exercise portion is locked by a locking means such as a spring loaded locking screw as illustrated in FIG. 1. In FIGS. 9-11, there is illustrated an embodiment of the internal locking mechanism 108 including a spring loaded locking screw. Lower center post 110 is connected to upper center post 200. A round plate 203 rests within an interior chamber 220 of hollow upper center post 200. Round plate 203 is affixed to one end of plate axle 204 with the opposite end of plate axle 204 affixed to restricted plate 207. An open round cap 205 seals interior chamber 220. A bushing ring 213 surrounds plate axle 203 within chamber 220.

A welded nut 208 is affixed onto a sidewall of lower center post 110 into which is threaded a spring loaded knob 209. Screws 212 are respectively threaded into oppositely disposed rivet nuts 211 to retain the lower center post 110 and upper center post 200 together. An upper center post axle 220 supports right connecting bar 22 and left connecting bar 42. A lower center post axle 206 supports horizontal bar 112. Referring to FIG. 11, the spring loaded knob 209 is illustrated in three different configurations. The spring loaded knob has a forward tooth 209A which is inserted into gap 203A in horizontal plate 203. To loosen the knob, the knob 209 should be rotated counterclockwise several times such as three times. This is illustrated in A of FIG. 11. As illustrated in Figure B of FIG. 11, the user then pulls the knob outwards and adjusts the seat simultaneously so that the tooth 209A cannot fit into the gap 203A. After this, the swiveling exercise can be performed. To return to the locked condition, the handles 20 and 40 are rotated so that the bars 22 and 42 cause the plate 203 to be rotated so that the gap 203A is once again aligned with the tooth 209A of the spring loaded knob 209 and then the user simply pushes the knob back inward until it clicks and then the knob can be tightened by rotating it in the opposite direction three times from the direction in which it was rotated. If the loosening direction is counterclockwise, then the tightening direction is clockwise. When the spring loaded knob 209 is tightened, the upper center post 200 cannot rotate and the swiveling exercise can not be performed. When the spring loaded knob is loosened, the upper center post 200 can rotate relative to the lower center post 110 by the mechanism described above so that the swivelling exercise can be performed.

Figure 2:
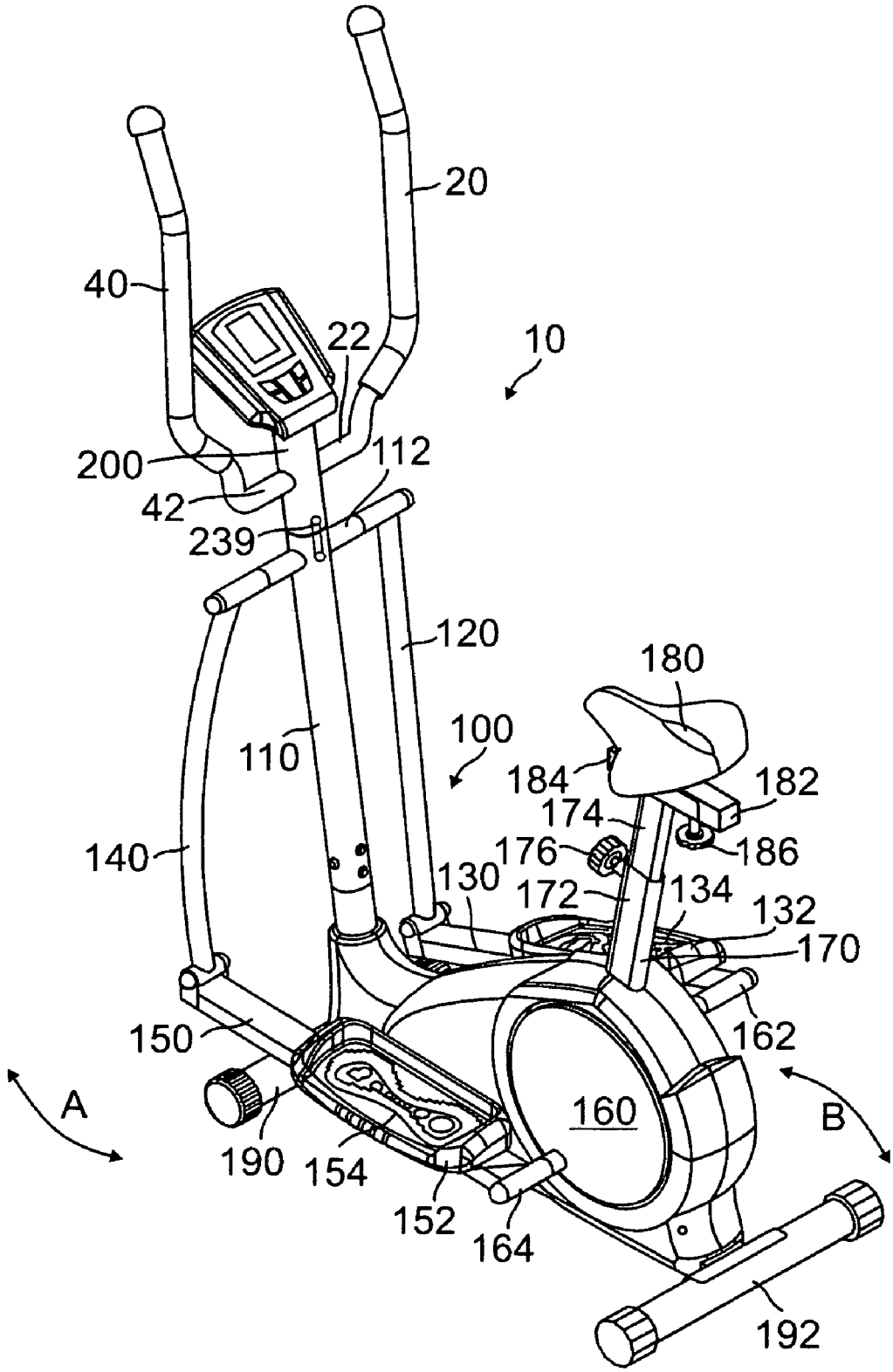
FIG. 2 is a perspective view of the present invention combination elliptical trainer exercise machine and abdominal swivelling exercise machine, with the swivelling apparatus locked by a wire so only the elliptical trainer exercise can be performed.

Referring to FIG. 2, there is illustrated a perspective view of the present invention elliptical trainer exercise machine 100 and abdominal swivelling exercise machine 10, with the swivelling apparatus locked by a wire 239 so only the elliptical exercise can be performed. The parts are the same as in FIG. 1 and the operation of the elliptical exercise is the same as described in FIG. 1. Only the rotational swivelling locking mechanism is different.

Figure 3:
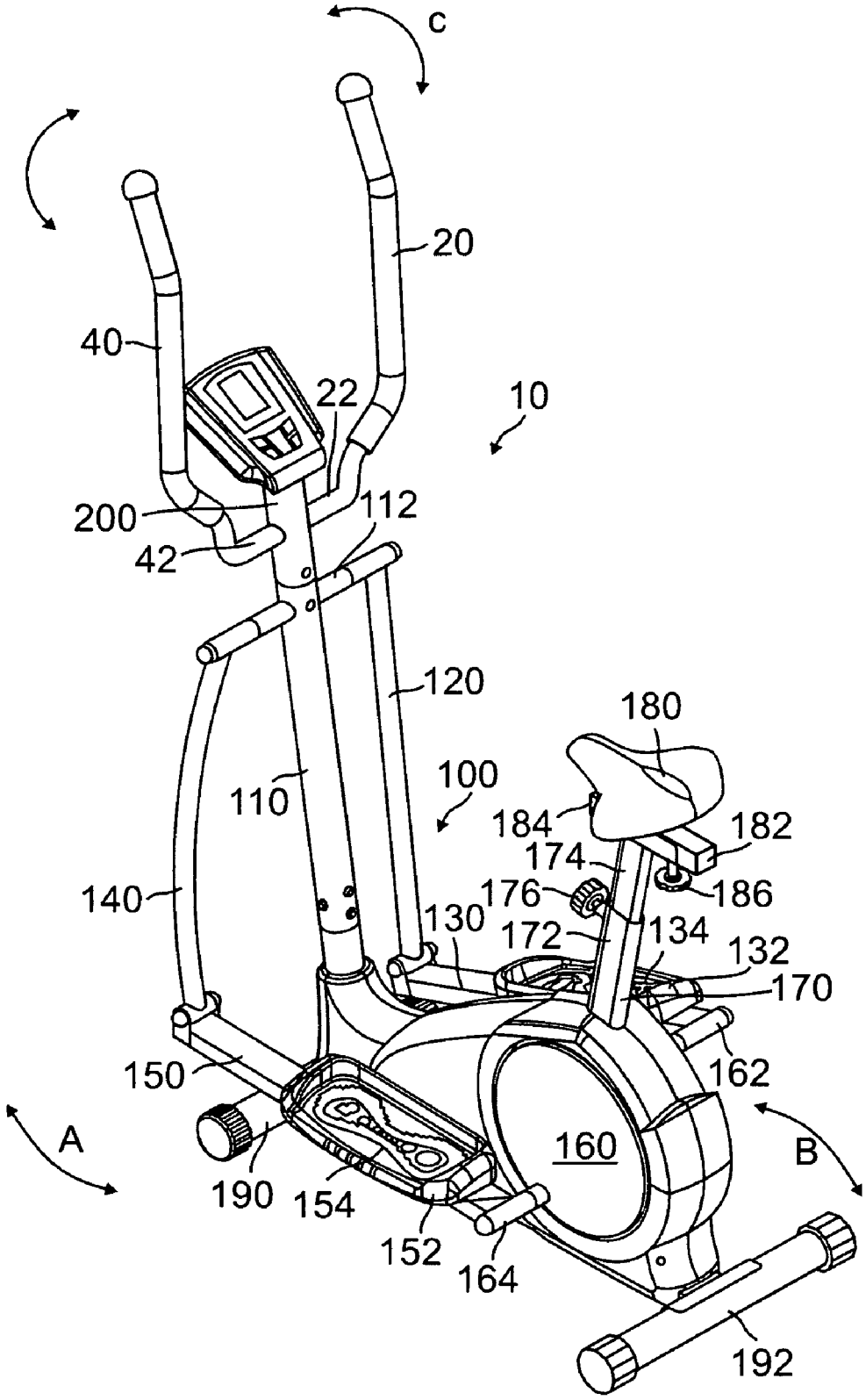
FIG. 3 is a perspective view of the present invention combination elliptical trainer exercise machine and abdominal swivelling exercise machine, with the swivelling apparatus unlocked so that both exercises can be performed.

Referring to FIG. 3, there is illustrated a perspective view of the present invention combination elliptical trainer exercise machine 100 and abdominal swivelling exercise machine 10, with the swivelling apparatus unlocked so that both exercises can be performed. The spring loaded knob 209 and/or the locking wire 239 have been released so that the upper center post 200 can now rotate in the horizontal direction, in the direction of arrow "C". A vertically extending right hand grip bar 20 is connected to the right side of upper center post 200 by right connecting bar 22 and a vertically extending left hand grip bar 40 is connected to the left side of upper center post 200 by left connecting bar 42.

The person exercising can now simultaneously perform the elliptical exercise and the abdominal swivelling exercise. In operation, a rider sits on seat 180 and places his right foot into right foot support plate 134 and places his left foot into left foot support plate 154. The rider can also hold onto right handle 20 and left handle 40 if he wishes. The pedaling action is in the direction of arrow "A" and an elliptical rotational motion of the legs and a back and forth rotational arc motion of the seat 180 in the direction of arrow "B" is caused by a pedaling action of the rider. In addition, the rider holds the right hand grip bar in his right hand and the left hand grip bar in his left hand and rotates the bars so that there is a horizontal motion that can go at least 270 degrees clockwise and counterclockwise to exercise the abdominal muscles with a swivelling rotational exercise. The user can engage in both the elliptical training exercise and the abdominal swivelling exercise simultaneously or perform them successively. Also, the user can stand on the foot support plates 134 and 154 and just perform the abdominal swivelling exercise in a standing position.

Figure 4:
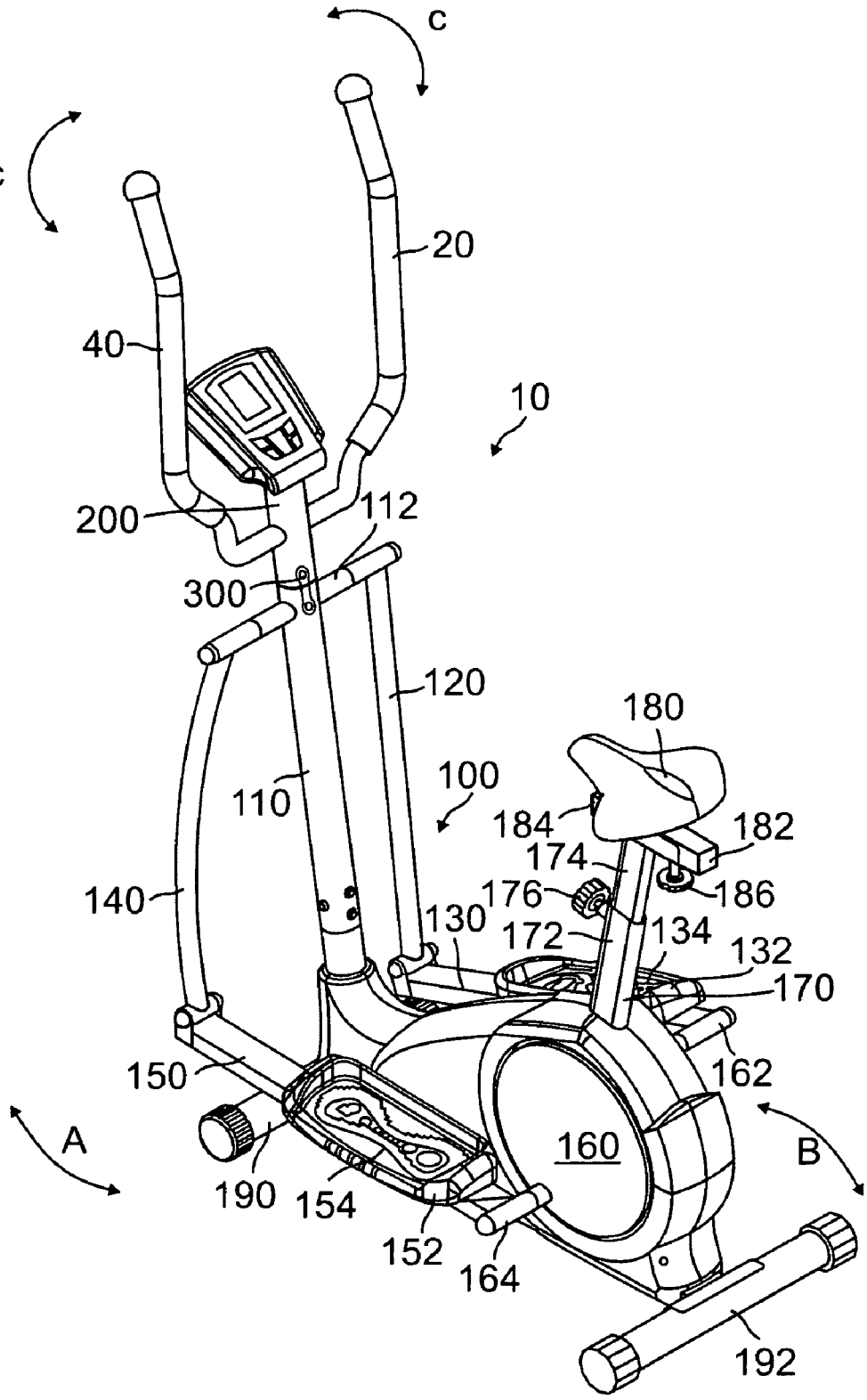
FIG. 4 is a perspective view of the present invention combination elliptical trainer exercise machine and abdominal swivelling exercise machine, with the swivelling apparatus unlocked so that both exercises can be performed, with additional resistance added on the swivelling apparatus.

Referring to FIG. 4, there is illustrated a perspective view of the present invention combination elliptical trainer exercise machine 100 and abdominal swivelling exercise machine 10, with the swivelling apparatus unlocked so that both exercises can be performed, with additional resistance in the form of a rubber-band or other resistance adding mechanism 300 interlocking the lower center post 110 and the upper center post 200 added on the swivelling apparatus 10. As a result, the difficulty of the rotational motion in the direction of arrow "C' is increased. The person exercising can now simultaneously perform the elliptical exercise and the abdominal swivelling exercise. In operation, a rider sits on seat 180 and places his right foot into right foot support plate 134 and places his left foot into left foot support plate 154. The rider can also hold onto right handle 20 and left handle 40 if he wishes. The pedaling action is in the direction of arrow "A" and an elliptical rotational motion of the legs and a back and forth rotational arc motion of the seat 180 in the direction of arrow "B" is caused by a pedaling action of the rider. In addition, the rider holds the right hand grip bar in his right hand and the left hand grip bar in his left hand and rotates the bars so that there is a horizontal motion that can go at least 270 degrees clockwise and counterclockwise to exercise the abdominal muscles with a swivelling rotational exercise. The user can engage in both the elliptical training exercise and the abdominal swivelling exercise simultaneously or perform them successively. Also, the user can stand on the foot support plates 134 and 154 and just perform the abdominal swivelling exercise in a standing position. The additional resistance 300 increases the effort required for the abdominal swivelling exercise.

Figure 5:
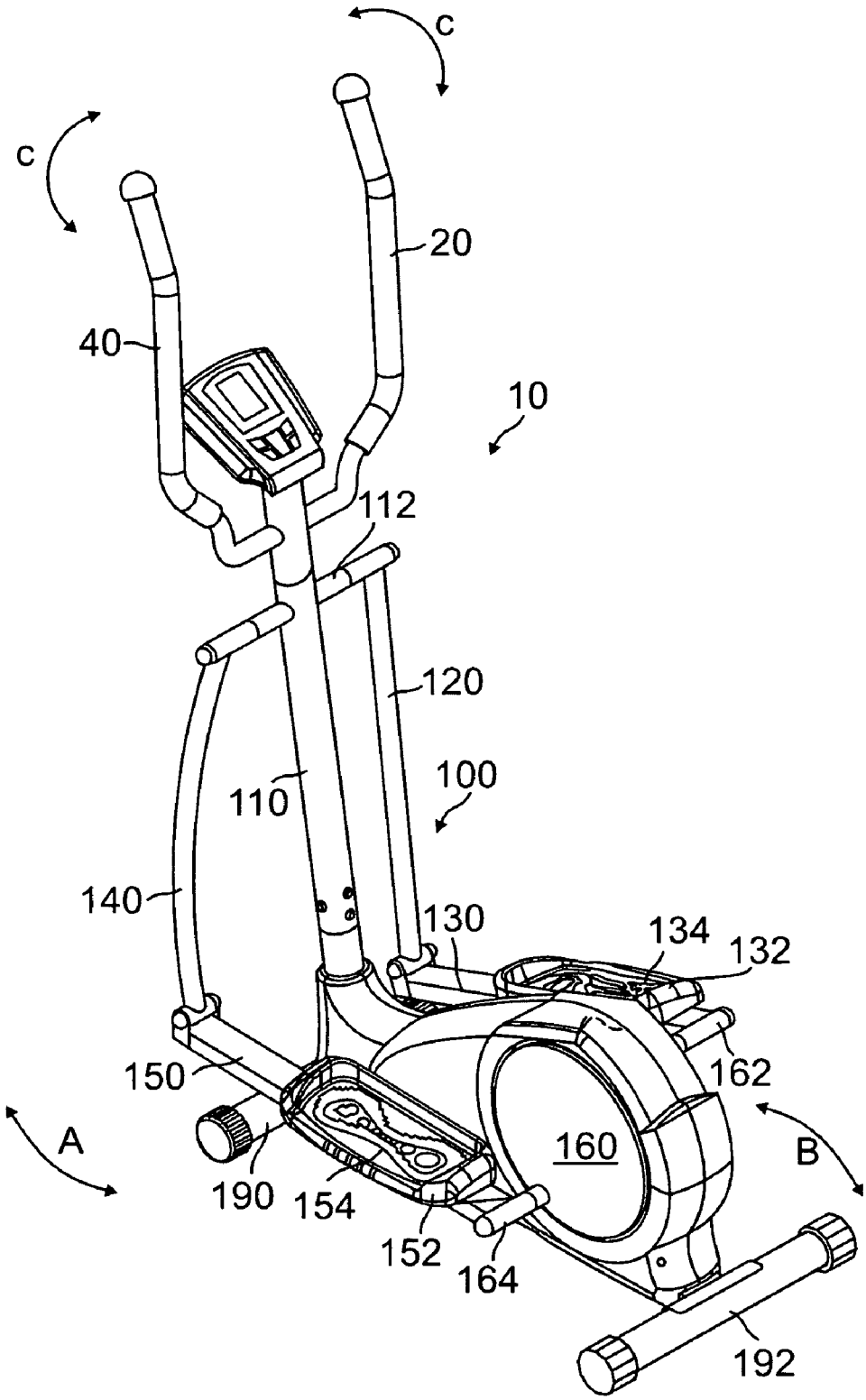
FIG. 5 is a perspective view of the present invention combination elliptical trainer exercise machine and abdominal swivelling exercise machine, with no swivelling locking apparatus so that both exercises can always be performed.

Referring to FIG. 5, there is illustrated a perspective view of the present invention combination elliptical trainer exercise machine 100 and abdominal swivelling exercise machine 10, with no swivelling locking apparatus so that both exercises can always be performed. The exercise is the same as described for FIG. 3. An additional abdominal swilled resistance can be added and then the abdominal swivelling exercise is the same as described in FIG. 4.

Figure 6:
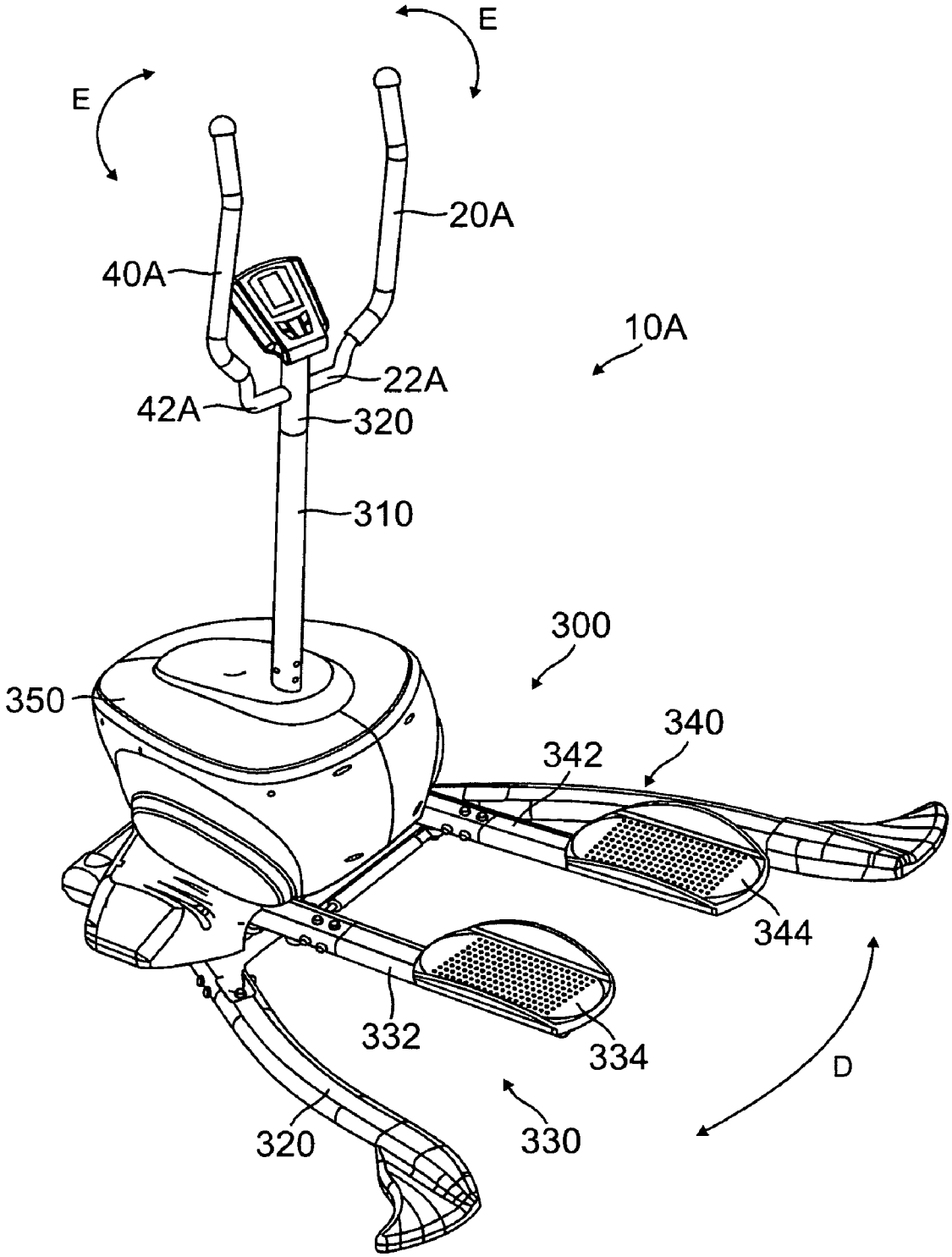
FIG. 6 is a perspective view of an alternative embodiment of the present invention combination skate simulation trainer exercise machine and abdominal swivelling exercise machine, with no swivelling locking apparatus so that both exercises can always be performed.

Referring to FIG. 6, there is illustrated a perspective view of a first alternative embodiment of the present invention combination skating simulation machine 310 and abdominal swivelling exercise machine 10A, with the swivelling apparatus unlocked by a pin so that both the skating exercise and swivelling exercise can be performed. The skating simulation portion 300 is fairly conventional and will only be briefly described. The present inventor Bob Hsiung is also the inventor of the skating simulation apparatus disclosed in claimed in U.S. Pat. No. 7,338,414 and U.S. Pat. No. 7,473,210. The skating simulation portion 300 has a lower central vertical post 310 connected to an upper central vertical post 320 which can rotate relative to the lower central post 300 by a mechanism comparable to the rotational mechanism described in FIGS. 9 through 11.

The skating machine portion 300 is supported by a pair of legs 320, 322. The skating machine portion 300 further comprises a first pedal assembly 330 having a first longitudinal pedal bar 332 to which a first foot pedal 334 is connected at one end. The first longitudinal pedal bar 332 is connected at its opposite end to an assembly within housing 350 so that it can rotate left to right in the direction of arrow "D". The skating machine portion 300 further comprises a second pedal assembly 340 having a second longitudinal pedal bar 342 to which a second foot pedal 344 is connected at one end. The second longitudinal pedal bar 442 is connected at its opposite end to an assembly within housing 350 so that it can rotate left to right in the direction of arrow "D".

In operation, a rider stands and places his left foot onto first foot pedal 334 and places his right foot onto second foot pedal 344 The rider can also hold onto right handle 20A and left handle 40A. The skating action of the rider's legs is a side-to-side motion in the direction of arrow "D".

The abdominal swivelling exercise portion 10A can be locked comparable to the assembly shown in FIGS. 1 and 2 with the rotational and locking assembly discussed in FIG. 9. Referring to FIG. 6, the swivelling apparatus 10A is unlocked so that both exercises can be performed. In the unlocked condition, the upper center post 320 can now rotate in the horizontal direction, in the direction of arrow "E". A vertically extending right hand grip bar 20A is connected to the right side of upper center post 320 by right connecting bar 22A and a vertically extending left hand grip bar 40A is connected to the left side of upper center post 320 by left connecting bar 42A.

The person exercising can now simultaneously perform the skating exercise and the abdominal swivelling exercise. In operation, a rider stands on foot pedals 334 and 344 and holds onto right handle 20A and left handle 40A. The skating action is in the direction of arrow "D" and the swiveling abdominal exercise is in the direction of arrow "E" so that there is a horizontal motion that can go at least 270 degrees clockwise and counterclockwise to exercise the abdominal muscles with a swivelling rotational exercise. The user can engage in both the skating exercise and the abdominal swivelling exercise simultaneously or perform them successively. Also, the user can stand on the foot pedals 334 and 344 and just perform the abdominal swivelling exercise in a standing position.

Figure 7:
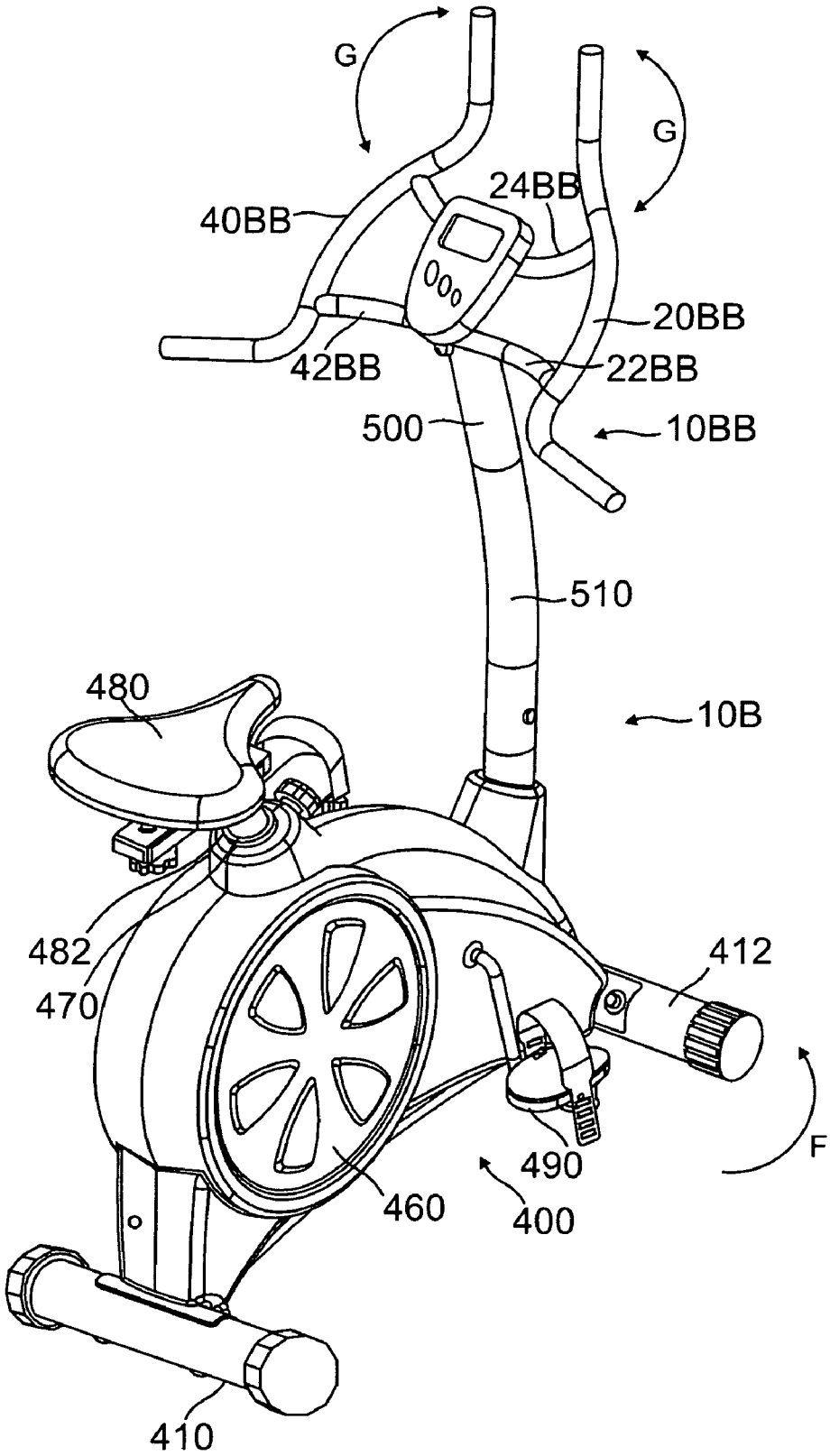
FIG. 7 is a perspective view of another alternative embodiment of the present invention combination exercise bicycle machine and abdominal swivelling exercise machine, with no swivelling locking apparatus so that both exercises can always be performed.

Referring to FIG. 7, there is illustrated a perspective view of a third embodiment of the present invention which is a combination exercise bicycle and abdominal swivelling exercise machine 10B. The swivelling apparatus can be locked by a pin as illustrated in FIG. 1 or locked as illustrated in FIG. 2 so only the exercise bicycle workout can be performed. The exercise bicycle portion 400 is fairly conventional and will only be briefly described. The exercise bicycle portion 400 is supported on legs 410 and 412 and comprises a rotating drum 460 connected to a seat post 470 supporting a seat 480. The rider sits on the seat 480 and places his feet in pedal stirrups (only the right stirrup 490 is shown). The stirrups are mechanically connected to the rotating drum 460 so that as a rider performs a pedaling action in the direction of arrow "F" the drum 460 rotates and the user can perform a bicycle pedaling exercise. The seat 480 is connected to a telescoping bar 482 with height adjustment means.

In operation, a rider sits on seat 480 and places his right foot into right foot stirrup 490 and his left foot into the left foot stirrup. The rider can also hold onto right handle 20BB and left handle 40BB if he wishes. The pedaling action is in the direction of arrow "F."

The abdominal swivelling exercise portion is shown unlocked in FIG. 7. Lower center post 510 is connected to upper center post 500. A rotation mechanism has been described in FIGS. 9 through 11. In the unlocked condition, the upper center post 500 can rotate relative to the lower center post 510 by the mechanism described above in FIGS. 9 through 11 so that the swivelling exercise can be performed.

Referring to FIG. 7, there is illustrated a perspective view of the present invention combination exercise bicycle 400 and abdominal swivelling exercise machine 10BB, with the swivelling apparatus unlocked so that both exercises can be performed.

A vertically extending right hand grip bar 20BB is connected to the right side of upper center post 500 by right connecting bar 22BB and a vertically extending left hand grip bar 40BB is connected to the left side of upper center post 500 by left connecting bar 42BB. The left and right handle grip bars 20BB and 40BB can also be connected by second connecting member 24BB. For the abdominal exercise, the rotational motion is in the direction of arrow "G".

Therefore, the rider can sit on seat 480 and perform a bicycle riding exercise and simultaneously or sequentially perform the abdominal swivelling rotational exercise. The bicycle riding action is in the direction of arrow "F" and the swiveling abdominal exercise is in the direction of arrow "G" so that there is a horizontal motion that can go at least 270 degrees clockwise and counterclockwise to exercise the abdominal muscles with a swivelling rotational exercise. The user can engage in both the bicycle riding exercise and the abdominal swivelling exercise simultaneously or perform them successively. Also, the user can just perform the abdominal swivelling exercise in a seated position.

Figure 8:
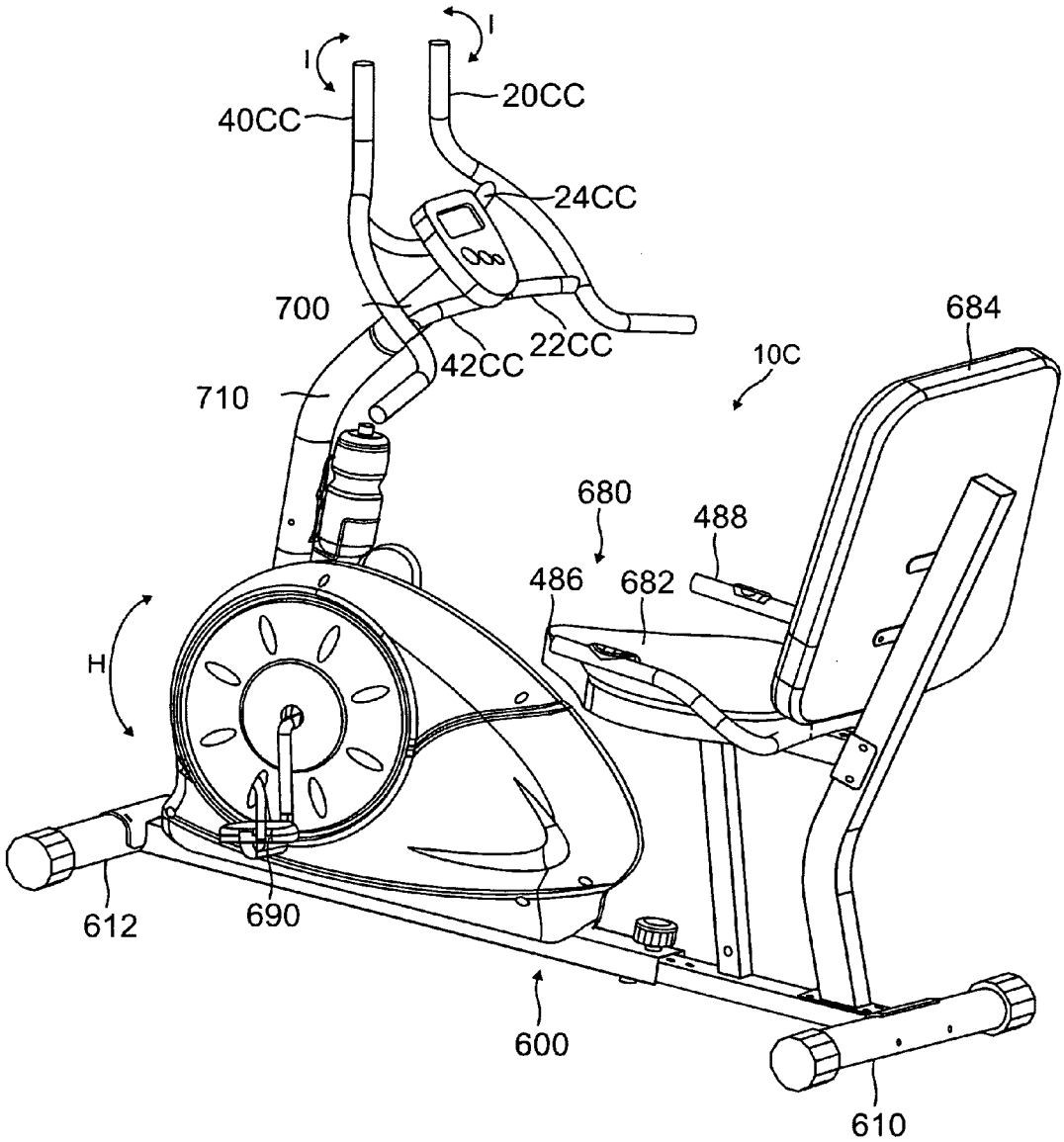
FIG. 8 is a perspective view of yet another alternative embodiment of the present invention combination recumbent exercise bicycle machine and abdominal swivelling exercise machine, with no swivelling locking apparatus so that both exercises can always be performed.

Referring to FIG. 8, there is illustrated a perspective view of a fourth embodiment of the present invention which is a combination recumbent exercise bicycle and abdominal swivelling exercise machine 10C. The swivelling apparatus can be locked by a pin as illustrated in FIG. 1 or locked as illustrated in FIG. 2 so only the recumbent exercise bicycle workout can be performed. The recumbent exercise bicycle portion 600 is fairly conventional and will only be briefly described. The recumbent exercise bicycle portion 600 is supported on legs 610 and 612 and comprises a rotating drum 660 connected to foot stirrups (only left stirrup 690) is shown. A seat 680 having a bottom 682 and back 684 has horizontal handles 486 and 488 on either side. The rider sits on the seat bottom 682 with his back against seat back 684 and places his feet in pedal stirrups (only the left stirrup 490 is shown). The stirrups are mechanically connected to the rotating drum 660 so that as a rider performs a pedaling action in the direction of arrow "H" the drum 660 rotates and the user can perform a recumbent bicycle pedaling exercise.

In operation, a rider sits on seat 680 and places his right foot into right foot stirrup 490 and his left foot into the left foot stirrup 690. The rider can also hold onto right handle 20CC and left handle 40CC if he wishes. The pedaling action is in the direction of arrow "H".

The abdominal swivelling exercise portion is shown unlocked in FIG. 8. Lower center post 710 is connected to upper center post 700. A rotation mechanism has been described in FIGS. 9 through 11. In the unlocked condition, the upper center post 700 can rotate relative to the lower center post 710 by the mechanism described above in FIGS. 9 through 11 so that the swivelling exercise can be performed.

Referring to FIG. 8, there is illustrated a perspective view of the present invention combination recumbent exercise bicycle 600 and abdominal swivelling exercise machine 10CC, with the swivelling apparatus unlocked so that both exercises can be performed. A vertically extending right hand grip bar 20BB is connected to the right side of upper center post 700 by right connecting bar 22CC and a vertically extending left hand grip bar 40BB is connected to the left side of upper center post 700 by left connecting bar 42CC. The left and right handle grip bars 20CC and 40CC can also be connected by second connecting member 24CC. For the abdominal exercise, the rotational motion is in the direction of arrow "I".

Therefore, the rider can sit on seat 680 and perform a recumbent riding exercise and simultaneously or sequentially perform the abdominal swivelling rotational exercise. The recumbent riding action is in the direction of arrow "H" and the swiveling abdominal exercise is in the direction of arrow "I" so that there is a horizontal motion that can go at least 270 degrees clockwise and counterclockwise to exercise the abdominal muscles with a swivelling rotational exercise. The user can engage in both the recumbent bicycle riding exercise and the abdominal swivelling exercise simultaneously or perform them successively. Also, the user can just perform the abdominal swivelling exercise in a seated position.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An exercise device comprising:

a. an elliptical trainer exercise machine combined with an abdominal swivelling exercise machine;

b. the elliptical trainer exercise machine comprises a central vertical post surrounding a horizontal bar, a right vertical post rotatably connected at one end to a right side of the horizontal bar and at its opposite end, the right vertical post is connected to a right horizontal support beam which supports a right foot rest member with an interior right foot support plate, a left vertical post is rotatably connected at one end to a left side of the horizontal bar, at its opposite end, the left vertical post is connected to a left horizontal support beam which supports a left foot rest member with an interior left foot support plate, a rotating drum connected to a seat post, the rotating drum has a right connection bar connected to a right horizontal support beam and a left connection bar connected to a left horizontal support beam; and c. the abdominal swivelling apparatus further comprises a non-movable lower vertical post supported by the right and left horizontal support beams of the elliptical trainer apparatus, an upper vertical center post rotatably connected to the lower vertical post, a vertically extending right hand grip bar connected to the right side of the upper vertical center post by a right connecting bar and a vertically extending left hand grip bar connected to a left side of the upper vertically extending center post by a left connecting bar;

d. whereby in operation a rider sits on the seat and places the rider's right foot into the right foot support plate and places the rider's left foot into the left foot support plate and the rider holds onto the right handle and left handle and engages in elliptical pedaling action and also engages in abdominal swivelling action.

2. The exercise device in accordance with claim 1 further comprising a locking mechanism to prevent the swiveling apparatus from rotating.

* * * * *